US007690339B2

(12) United States Patent
Fuwa et al.

(10) Patent No.: US 7,690,339 B2
(45) Date of Patent: Apr. 6, 2010

(54) CONTROL DEVICE AND METHOD FOR VARIABLE VALVE MECHANISM

(75) Inventors: Naohide Fuwa, Nishikamo-gun (JP); Masashi Kishimoto, Toyota (JP)

(73) Assignees: Toyota Jidosha Kabushiki Kaisha, Toyota (JP); Fujitsu Ten Limited, Kobe-shi (JP)

( * ) Notice: Subject to any disclaimer, the term of this patent is extended or adjusted under 35 U.S.C. 154(b) by 409 days.

(21) Appl. No.: 11/713,750

(22) Filed: Mar. 5, 2007

(65) Prior Publication Data

US 2007/0227479 A1 Oct. 4, 2007

(30) Foreign Application Priority Data

Mar. 28, 2006 (JP) ..... 2006-088383

(51) Int. Cl.
*F01L 1/34* (2006.01)

(52) U.S. Cl. ..... 123/90.16; 123/90.15

(58) Field of Classification Search ..... 123/90.15, 123/90.16, 90.31
See application file for complete search history.

(56) References Cited

U.S. PATENT DOCUMENTS

2004/0094107 A1* 5/2004 Nakano et al. ..... 123/90.16
2005/0098127 A1* 5/2005 Eiraku ..... 123/90.15

FOREIGN PATENT DOCUMENTS

| | | |
|---|---|---|
| JP | A-2002-256905 | 2/2001 |
| JP | A 2001-263015 | 9/2001 |
| JP | A-2001-263101 | 9/2001 |
| JP | A 2002-256905 | 9/2002 |
| JP | A-2005-146883 | 6/2005 |

* cited by examiner

*Primary Examiner*—Zelalem Eshete
(74) *Attorney, Agent, or Firm*—Oliff & Berridge, PLC

(57) ABSTRACT

A variable valve timing and lift mechanism includes an actuator that adjusts the period in which an intake valve is held open by moving a drive element. When a control unit switches the duration, the control unit controls the actuator so that the duration is changed at a first speed when the duration is equal to a first value, and at a second speed when the duration is equal to a second value that is smaller than the first value. The absolute value of the second speed is smaller than the absolute value of the first speed. In effect, the actuator is controlled so that when the duration is in a short-duration range, the duration changes more slowly than when the duration is in a long-duration range.

12 Claims, 11 Drawing Sheets

CONTROL DEVICE AND METHOD FOR VARIABLE VALVE MECHANISM

INCORPORATION BY REFERENCE

The disclosure of Japanese Patent Application No. 2006-088383 filed on Mar. 28, 2006 including the specification, drawings and abstract is incorporated herein by reference in its entirety.

BACKGROUND OF THE INVENTION

1. Field of the Invention

The invention relates to a control device and method for a variable valve mechanism. More particularly, the invention relates to a control device and method for a variable valve mechanism that changes the operational characteristic of an intake valve in an internal combustion engine.

2. Field of the Invention

In a conventional control device for an internal combustion engine with a variable valve mechanism, Japanese Patent Application Publication No. 2001-263015 (JP 2001-263015) describes a variable valve mechanism that continuously changes the lift of an intake valve and the period in which the intake valve is held open. The term "duration" indicates the period of time that the intake valve is held open in terms of crank angle.

The above-described variable valve mechanism includes an intermediate drive mechanism provided between a camshaft and the intake valve. A support pipe oscillably supports the intermediate drive mechanism. When an intake cam contacts the input portion of the intermediate drive mechanism to drive the intermediate drive mechanism, the oscillating cam of the intermediate drive mechanism drives the intake valve via a rocker arm. A variable-lift actuator changes the lift by changing the difference between the phases of the oscillating cam and the input portion of the intermediate drive mechanism. Thus, the lift and duration of the intake valve are continuously adjusted.

In the above-described variable valve mechanism, the variable-lift actuator drives a control shaft, and the control shaft changes the difference between the phases of the oscillating cam and the input portion. As a result, it is possible to change the lift and duration of the intake valve that is moved by the rotation of the intake cam.

For example, when the engine starts, the viscosity of lubricating oil may be high due to the low temperature of the engine or motor. In this case, the variable-lift actuator may not move smoothly. Therefore, when the engine starts, it is desirable to execute a control that maintains the duration at a large value, and adjusts the intake air amount by changing the opening amount of the throttle valve. After the engine is warmed up completed, it is desirable to start another control that changes the duration.

When an operation mode is changed to decrease the duration (the period in which the intake valve is held open), the duration and the intake air amount do not change uniformly. Therefore, the variable valve mechanism needs to be controlled so that the driver does not feel discomfort.

SUMMARY OF THE INVENTION

The invention provides a control device and method for a variable valve mechanism that improves the drivability of a vehicle.

The invention relates to a control device for a variable valve mechanism that changes the operational characteristic of an intake valve provided in an internal combustion engine. The control device includes a control unit, a drive element, and an actuator, provided in the variable valve mechanism, that changes a duration of the intake valve by moving the drive element. When the control unit changes the duration of the intake valve, the control unit controls the actuator so that the duration changes at a first speed when the duration is equal to a first value, and changes at a second speed when the duration is equal to a second value that is smaller than the first value. The absolute value of the second speed is smaller than the absolute value of the first speed.

The control unit may control the actuator so that the duration changes at the first speed when the duration is in a long-duration range that includes the first value, and changes at the second speed when the duration is in a short-duration range that includes the second value.

The control device may further include a motor provided in the actuator, and a positioning mechanism, also provided in the actuator, that positions the drive element according to a rotational position of a rotor of the motor. The control unit may control the motor so that the rotational speed of the motor when the duration is equal to the second value is lower than the rotational speed of the motor when the duration is equal to the first value.

The control unit may control the opening amount of a throttle valve in accordance with the duration of the intake valve.

According to the invention, when the duration is changed, the drivability of the vehicle is improved.

BRIEF DESCRIPTION OF THE DRAWINGS

The foregoing and further objects, features, and advantages of the invention will become apparent from the following descriptions of preferred embodiments with reference to the accompany drawings, wherein like numerals are used to represent like elements and wherein.

DETAILED DESCRIPTION OF THE EXAMPLE EMBODIMENTS

Figure 1:
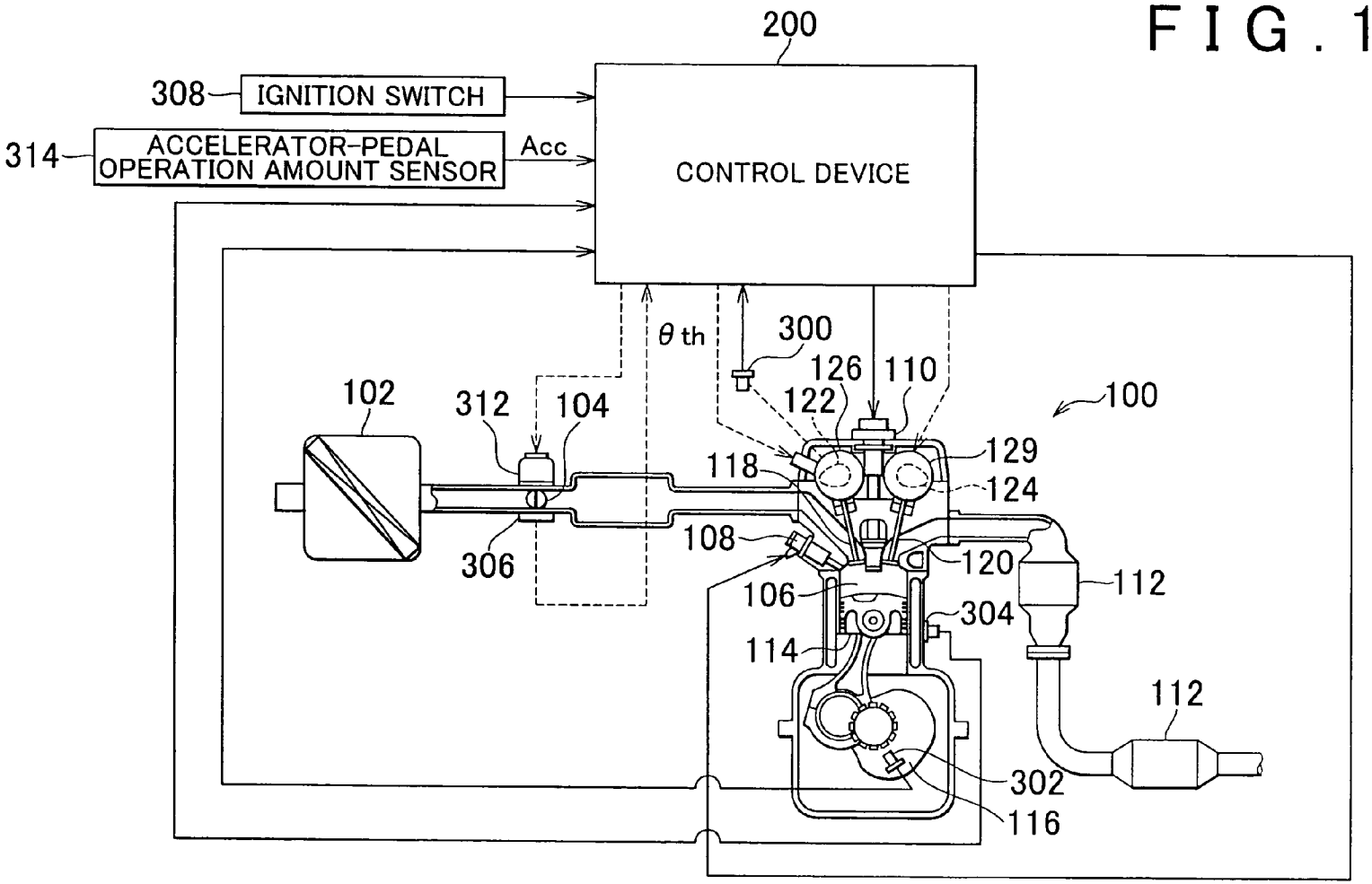
FIG. 1 is a diagram showing the configuration of an engine according to an embodiment of the invention.

Hereinafter, an embodiment of the invention will be described in detail with reference to the drawings. In the drawings, the same or corresponding portions are denoted by the same reference numerals, and redundant description thereof will be omitted.

FIG. 1 shows the configuration of an engine 100 according to the embodiment of the invention. As shown in FIG. 1, a control unit for a variable valve mechanism according to the embodiment is realized when a control unit 200 in FIG. 1 executes programs.

Air is taken into the engine 100 through an air cleaner 102. A throttle valve 104 adjusts the amount of air taken into the engine 100. The throttle valve 104 is an electrically controlled throttle valve driven by a throttle motor 312.

Air is mixed with fuel in a cylinder 106 (combustion chamber). An injector 108 injects fuel directly into the cylinder 106. That is, the injection hole of the injector 108 is positioned in the cylinder 106. Fuel is injected from the intake-side of the cylinder 106 (i.e., the side from which air is introduced).

Fuel is injected during an intake stroke. However, the timing at which fuel is injected is not limited to the timing during the intake stroke. In this embodiment, the engine 100 is a direct-injection engine in which the injection hole of the injector 108 is positioned in the cylinder 106. However, in addition to the injector 108 that injects fuel directly into the cylinder 106, another injector that injects fuel into an intake port may be provided. Alternatively, only the injector that injects fuel into the intake port may be provided.

The air-fuel mixture in the cylinder 106 is ignited by an ignition plug 110, and burned. After the air-fuel mixture is burned, exhaust gas is purified by a three-way catalyst 112. Then, the exhaust gas is discharged to the outside of a vehicle. By burning the air-fuel mixture, a piston 114 is pushed downward, and a crankshaft 116 rotates.

A pair of intake valves 118 and a pair of exhaust valves 120 are provided in the top portion of the cylinder 106. Each intake valve 118 controls the amount of air introduced into the cylinder 106 and the timing at which air is introduced into the cylinder 106. Each exhaust valve 120 controls the amount of exhaust gas discharged from the cylinder 106 and the timing at which the exhaust gas is discharged from the cylinder 106. A cam 122 drives the intake valve 118. A cam 124 drives the exhaust valve 120.

A variable valve timing and lift mechanism (hereinafter, referred to as "VVTL mechanism) 126 controls the opening/closing timings, the lift, and the duration of the intake valve 118. A variable valve timing mechanism (hereinafter, referred to as "VVT mechanism) 129 controls the opening/closing timings of the exhaust valve 120. The lift and the duration of the exhaust valve 120 may also be controlled.

The VVTL mechanism 126 is formed by combining the VVT mechanism with the VVL mechanism that controls the lift and the duration. The VVL mechanism may control either the lift or the duration.

In this embodiment, the VVT mechanism controls the opening/closing timings of the intake valve 118 by rotating the cam 122. The method of controlling the opening/closing timings is not limited to this method. As the VVT mechanism, a known ordinary VVT mechanism is used. Therefore, detailed description of the VVT mechanism will be omitted. The VVL mechanism will be described later.

The control unit 200 controls a throttle-valve opening amount θth, an ignition timing, a fuel-injection timing, the amount of fuel to be injected, and the operating state of the intake valve 118 (for example, the opening/closing timings, lift, and duration) to operate the engine 100 in a desired state. The control unit 200 receives signals from a cam-angle sensor 300, a crank-angle sensor 302, a knock sensor 304, a throttle-valve opening amount sensor 306, an ignition switch 308, and an accelerator-pedal operation amount sensor 314.

The cam-angle sensor 300 outputs a signal that indicates the position of the cam. The crank-angle sensor 302 outputs signals that indicate the rotational speed of the crankshaft 116 (i.e., engine speed), and the rotational angle of the crankshaft 116. The knock sensor 304 outputs a signal that indicates the intensity of vibrations of the engine 100. The throttle-valve opening amount sensor 306 outputs the signal that indicates the throttle-valve opening amount θth. When the driver turns the ignition switch 308 on, the ignition switch 308 outputs the signal to indicate that the ignition switch 308 is on. The accelerator-pedal operation amount sensor 314 outputs a signal that indicates the accelerator-pedal operation amount Acc corresponding to the amount by which accelerator pedal is depressed.

The control unit 200 controls the engine 100 based on the signals from the sensors, and maps and programs stored in memory (not shown).

Figure 2:
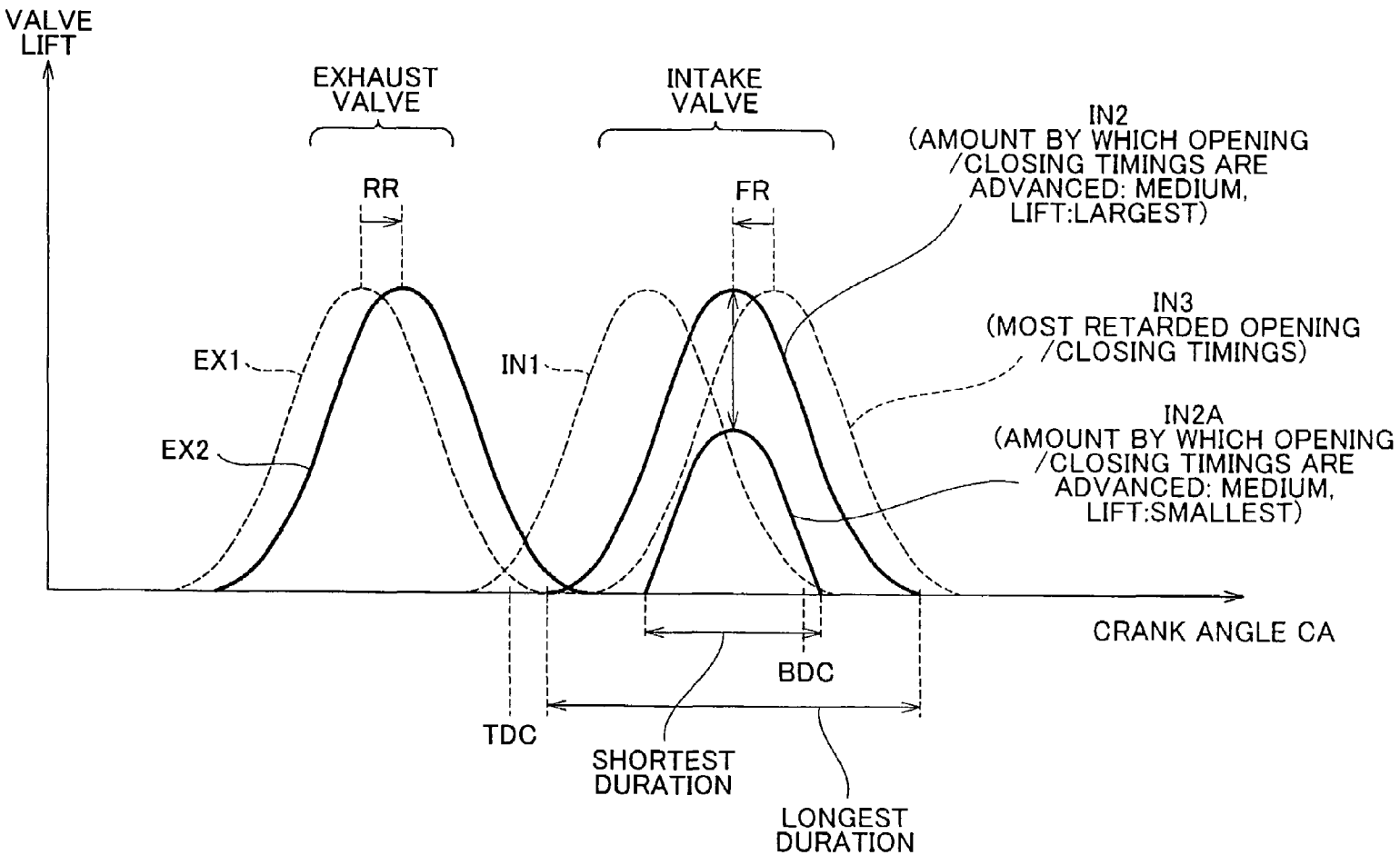
FIG. 2 is a diagram showing the relation between a valve lift and a crank angle in a variable valve mechanism.

FIG. 2 shows the relation between the valve lift and the crank angle in the variable valve mechanism.

As shown in FIG. 2, the exhaust valve opens and closes during the exhaust stroke, and the intake valve opens and closes during the intake stroke. Waveforms EX1, EX2 indicate the lift of the exhaust valve. Waveforms IN1 to IN3, and IN2*a* indicate the lift of the intake valve. The VVT mechanism 129 for the exhaust valve changes the opening/closing timings of the exhaust valve in the range from the opening/closing timings indicated by the waveform EX1 to the opening/closing timings indicated by the waveform EX2. The arrow RR indicates the amount by which the opening/closing timings of the exhaust valve are retarded with respect to the most advanced opening/closing timings indicated by the waveform EX1.

The VVT mechanism for the intake valve changes the opening/closing timings of the intake valve in the range from the opening/closing timings indicated by the waveform IN1 to the opening/closing timings indicated by the waveform IN3. The arrow FR indicates the amount by which the opening/closing timings of the intake valve are advanced with respect to the most retarded opening/closing timings indicated by the waveform IN3.

The top dead center is referred to as "TDC". The bottom dead center is referred to as "BDC". Both of the exhaust valve and the intake valve are open when the piston is near TDC. The period in which both of the exhaust valve and the intake valve are open is referred to as "overlap period". The VVT mechanisms for the intake valve and the exhaust valve adjust the overlap period. If the overlap period increases when the engine speed is high, a large amount of air is taken into the cylinder to improve the output of the engine. If the overlap period increases when the engine speed is low, exhaust gas returns into the cylinder, and combustion is made unstable.

Further, the lift and duration of the intake valve can be changed in a given range.

That is, the lift in the waveform IN2 is at its maximum, and the lift in the waveform IN2A is at its minimum. The duration represents the period in which the intake valve is held open in terms of crank angle. The duration in the waveform IN2 is longest, and the duration in the waveform IN2*a* is shortest.

Figure 3:
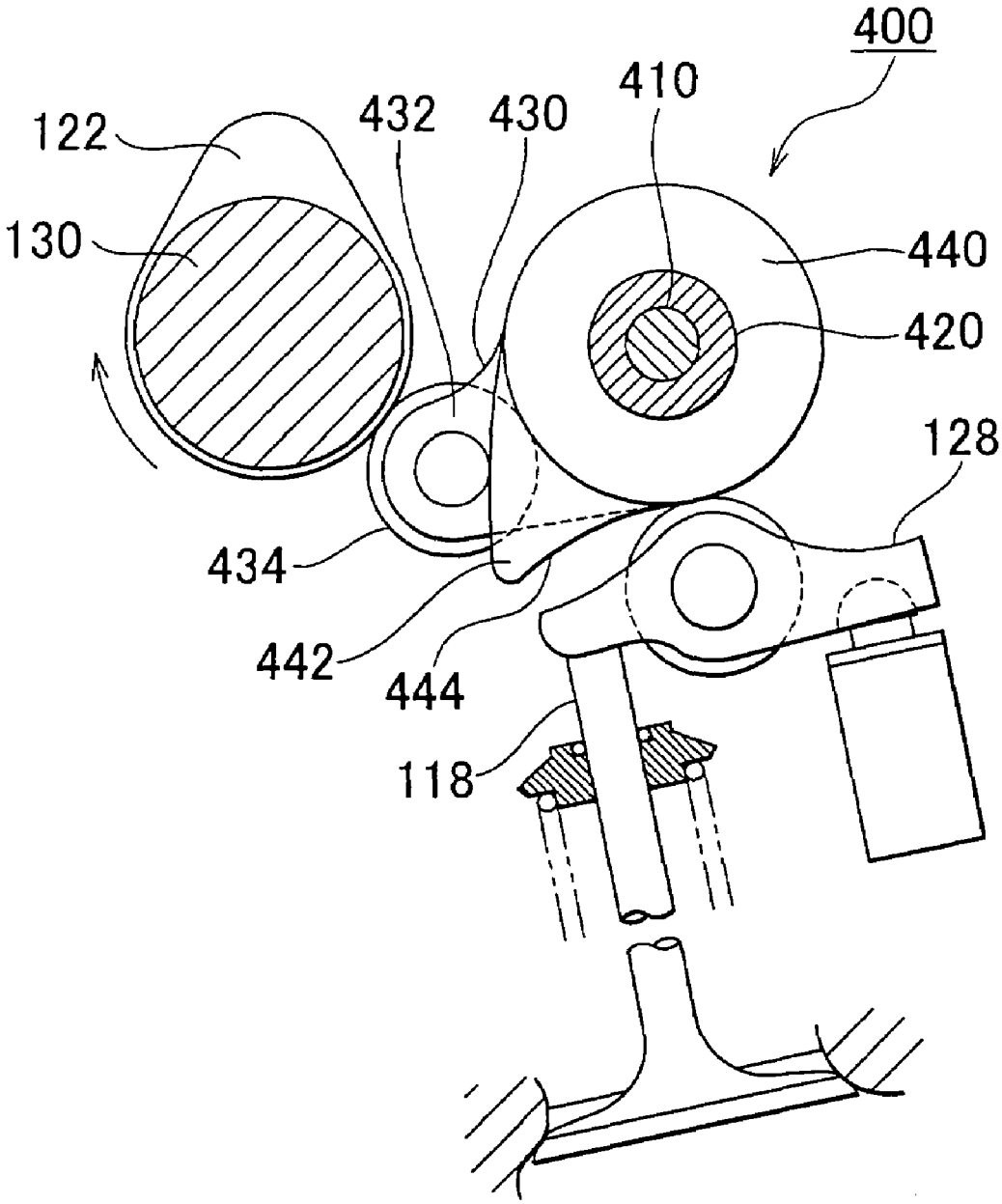
FIG. 3 is a front view showing a VVL mechanism that controls the lift and duration of an intake valve.

FIG. 3 is a front view of the VVL mechanism 400 that controls the lift and duration of the intake valve.

As shown in FIG. 3, the VVL mechanism 400 includes a drive shaft 410, a support pipe 420, an input arm 430, and an oscillating cam 440. The drive shaft 410 extends in one direction. The support pipe 420 covers the outer surface of the drive shaft 410. The input arm 430 and the oscillating cam 440 are provided around the outer surface of the support pipe 420, and are arranged in the axial direction of the drive shaft 410. The actuator, which linearly moves the drive shaft 410, is provided at the end of the drive shaft 410.

In the VVL mechanism 400, one cam 122 is provided for each cylinder. One input arm 430 corresponds to the one cam 122. One oscillating cam 440 is provided on one side of the input arm 430, and another oscillating cam 440 is provided on the other side of the input arm 430. The two oscillating cams 440 correspond to the pair of intake valves 118 provided for each cylinder.

The support pipe 420 has a hollow cylindrical shape. The support pipe 420 is disposed in parallel with the camshaft 130. The support pipe 420 is fixed to a cylinder head to prevent the axial movement or rotation of the support pipe 420.

The drive shaft 410 is inserted into the support pipe 420 such that the drive shaft 410 slidably moves in the axial direction. The input arm 430 and the two oscillating cams 440 are provided around the outer surface of the support pipe 420. The input arm 430 and the two oscillating cams oscillate around the axis of the drive shaft 410, but do not move in the axial direction.

The input arm 430 includes an arm portion 432 and a roller portion 434. The arm portion 432 protrudes away from the outer surface of the support pipe 420. The roller portion 434 is connected to the end of the arm portion 432 such that the roller portion 434 rotates. The input arm 430 is positioned such that the roller portion 434 contacts the cam 122.

The oscillating cam 440 includes a lobe portion 442 that has a substantially triangle shape. The lobe portion 442 protrudes away from the outer surface of the support pipe 420. The lobe portion 442 has a cam surface 444 that has a concave shape. A roller is fitted to a rocker arm 128 such that the roller rotates. The roller is pressed to the cam surface 444 by the force of a valve spring provided in the intake valve 118.

The input arm 430 and the oscillating cam 440 integrally oscillate around the axis of the drive shaft 410. Therefore, when the camshaft 130 rotates, the input arm 430, which is in contact with the cam 122, oscillates, and the oscillating cam 440 also oscillates due to the movement of the input arm 430. The movement of the oscillating cams 440 is transmitted to the intake valve 118 via the rocker arm 128. Thus, the intake valve opens and closes.

The VVL mechanism 400 further includes a mechanism that changes the difference between the phases of the input arm 430 and the oscillating cam 440 around the axis of the support pipe 420. This mechanism appropriately changes the lift and duration of the intake valve 118.

That is, when the phase difference increases, the oscillation angle of the rocker arm 128 with respect to the oscillation angle of the input arm 430 and the oscillating cam 440 increases. This increases the lift and duration of the intake valve 118.

When the phase difference decreases, the oscillation angle of the rocker arm 128 with respect to the oscillation angle of the input arm 430 and the oscillating cam 440 decreases. This decreases the lift and duration of the intake valve 118.

Figure 4:
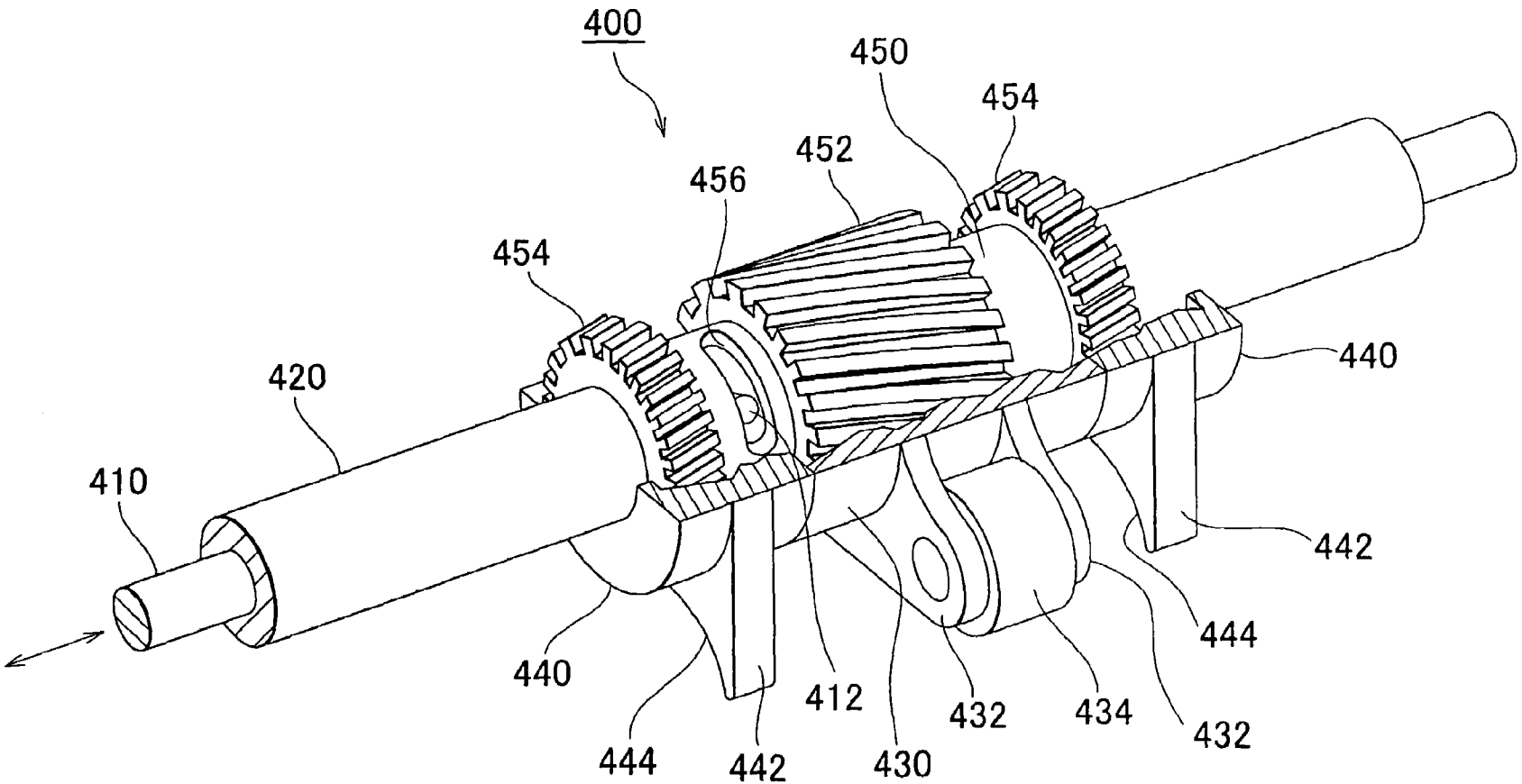
FIG. 4 is a perspective view partially showing the VVL mechanism.

FIG. 4 is a perspective view that shows part of the VVL mechanism. In FIG. 4, a cutaway view of the VVL shows the internal structure of the VVL mechanism.

As shown in FIG. 4, a slider gear 450 is housed in the space defined by the input arm 430, the two oscillating cams 440, and the outer surface of the support pipe 420. The slider gear 450 is supported on the support pipe 420. The slider gear 450 rotates around the support pipe 420, and slides on the support pipe 420 in the axial direction.

A helical gear 452 is provided at the center of the slider gear 450 in the axial direction. The right-hand helical spline is formed in the helical gear 452. Helical gears 454 are provided on the sides of the helical gear 452. The left-hand helical spline is formed in each helical gear 454.

Helical splines are formed on the inner surfaces of the input arm 430 and the two oscillating cams 440. The helical splines engage with the helical gears 452 and 454. That is, the right-hand helical spline is formed on the inner surface of the input arm 430. The right-hand helical spline engages with the helical gear 452. The left-hand helical spline is formed on the inner surface of each oscillating cam 440. The left-hand helical spline engages with the helical gear 454.

A long hole 456 is formed in the slider gear 450 at the position between one helical gear 454 and the helical gear 452. The long hole 456 extends in the circumferential direction. A long hole (not shown) is formed in the support pipe 420. The long hole (not shown) extends in the axial direction, and partially overlaps the long hole 456. An engagement pin 412 is integrally formed on the drive shaft 410. The drive shaft 410 is inserted into the support pipe 420. The engagement pin 412 protrudes through the area where the long hole 456 and the long hole (not shown) partially overlap with each other.

When the drive shaft 410 moves in the axial direction, the engagement pin 412 pushes the slider gear 450. As a result, the helical gears 452 and 454 simultaneously move in the axial direction of the drive shaft 410. However, the input arm 430 and the oscillating cams 440, which engage with the helical gears 452 and 454 through splines, do not move in the axial direction. Therefore, the input arm 430 and the oscillating cams 440 pivot around the drive shaft 410 due to the engagement of the helical splines.

The torsional direction of the helical spline formed on the inner surface of the input arm 430 is opposite to the torsional direction of the helical spline formed on the inner surface of the oscillating cam 440. Therefore, the input arm 430 and the oscillating cam 440 pivot in the opposite directions. Thus, the difference between the phases of the input arm 430 and the oscillating cam 440 can be changed. This permits the lift and duration of the intake valve 118 to be changed in the manner described above. However, the configuration of the VVL mechanism is not limited to this configuration.

Figure 5:
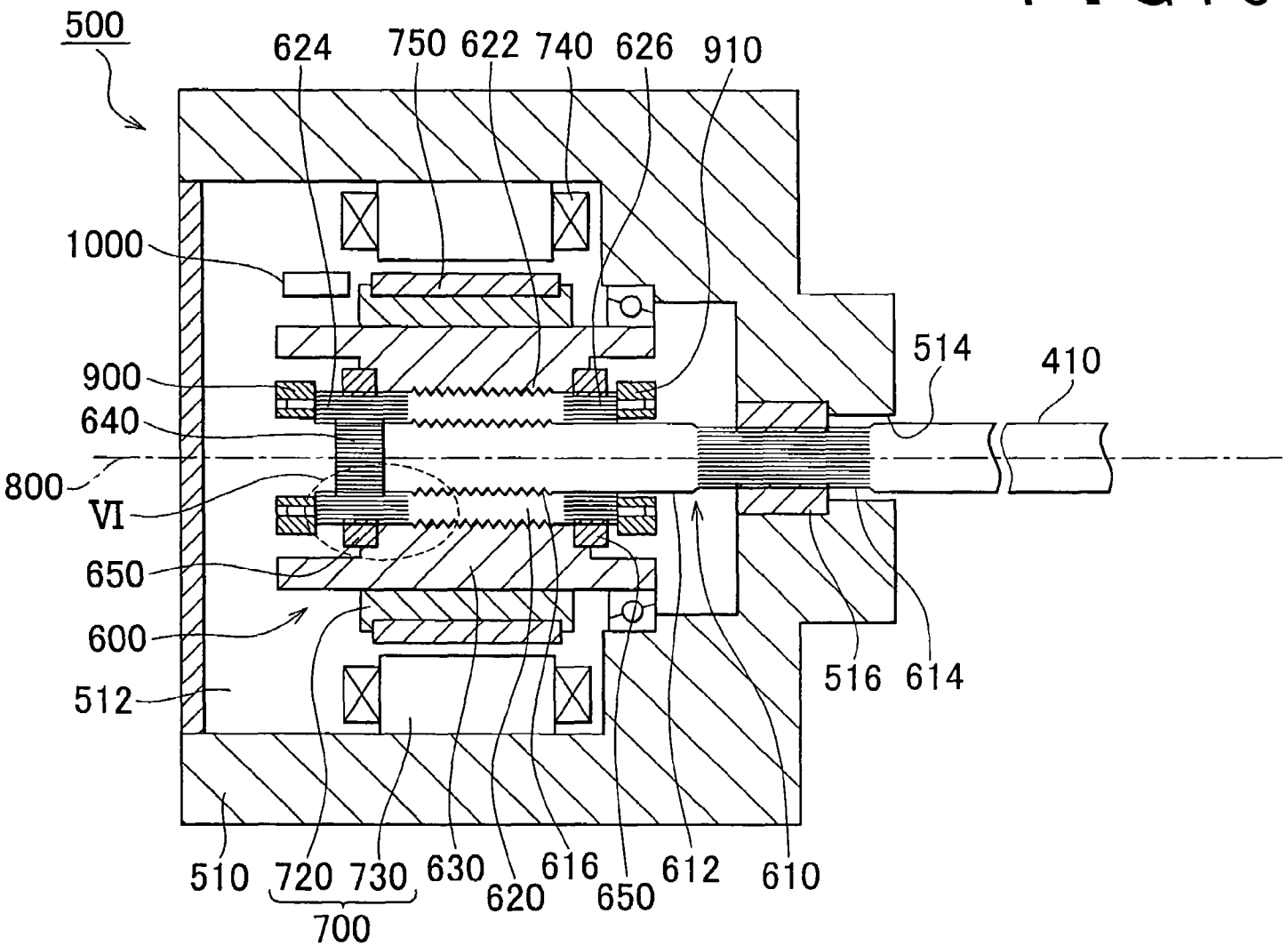
FIG. 5 is a sectional view showing an actuator that linearly moves the drive shaft of the VVL mechanism in an axial direction.

FIG. 5 is a sectional view showing an actuator 500 that linearly moves the drive shaft 410 of the VVL mechanism 400.

As shown in FIG. 5, the actuator 500 includes a housing 510, a differential roller gear 600, and a motor 700. The housing 510 defines a space 512. The differential roller gear 600 converts rotational movement to linear movement. The motor 700 inputs the rotational movement to the differential roller gear 600. An opening 514 is formed in the housing 510. The opening 514 is open toward the cylinder head on which the VVL mechanism 400 is provided.

The differential roller gear 600 includes a sun shaft 610, a plurality of planetary shafts 620, and a nut 630. The sun shaft 610 extends along an axis 800. The planetary shafts 620 extend on the outer surface of the sun shaft 610 in parallel with the axis 800. The planetary shafts 620 are arranged around the axis 800 in the circumferential direction. The nut 630, which has a cylindrical shape, is formed around the axis 800 to surround the planetary shafts 620.

The sun shaft 610, which extends along the axis 800, is aligned with the drive shaft 410. The sun shaft 610 protrudes from the space 512 to the outside of the housing 510 through the opening 514. The sun shaft 610 is connected to the drive shaft 410 using a coupling or the like (not shown).

The sun shaft 610 includes a spline portion 614 and a thread portion 616. A spline is formed in the spline portion 614. A male thread is formed in the thread portion 616. A ring-shaped sun gear 640 is fitted to the end of the sun shaft 610, which is positioned in the space 512. A spur gear is formed on the outer surface of the sun gear 640. In the spur gear, teeth are arranged around the axis 800 in the circumferential direction.

A stopper collar 516 is fixed to the sun shaft 610 to surround the spline portion 614. A spline is formed on the inner surface of the stopper collar 516. By engaging the stopper collar 516 with the spline portion 614, the rotational movement of the sun shaft 610 around the axis 800 is restricted.

Retainers 900 and 910 are provided at the ends of the planetary shaft 620. Each of the retainers 900 and 910 having a ring shape is provided around the axis 800. The retainers 900 and 910 support the ends of the planetary shafts 620 such that the planetary shafts 620 rotate. The retainers 900 and 910 are positioned at a predetermined interval in the direction of the axis 800. A support column that extends in parallel with the planetary shafts 620 connects the retainers 900 and 910 to each other.

The motor 700 includes a rotor 720 and a stator 730. The rotor 720 may be fixed to the outer surface of the nut 630, for example, by shrinkage fitting, press fitting, or an adhesive agent. A stator 730 may be fixed to the housing 510, for example, by shrinkage fitting, press fitting, or an adhesive agent. A coil 740 is wound around the stator 730.

The stator 730, having a ring shape, is provided around the axis 800 to surround the rotor 720. The rotor 720 is positioned around the axis 800 along the circumferential direction such that a predetermined space formed between the rotor 720 and the stator 730. Permanent magnets 750 are disposed on the rotor 720 at intervals of a predetermined angle around the axis 800 such that the permanent magnets 750 face the stator 730. By supplying electric power to the coil 740, a magnetic field is generated between the rotor 720 and the stator 730. Thus, the rotor 720 and the nut 630 rotate around the axis 800.

Each planetary shaft 620 includes a thread portion 622, and gear portions 624 and 626 that are formed on the sides of the thread portion 622.

Figure 6:
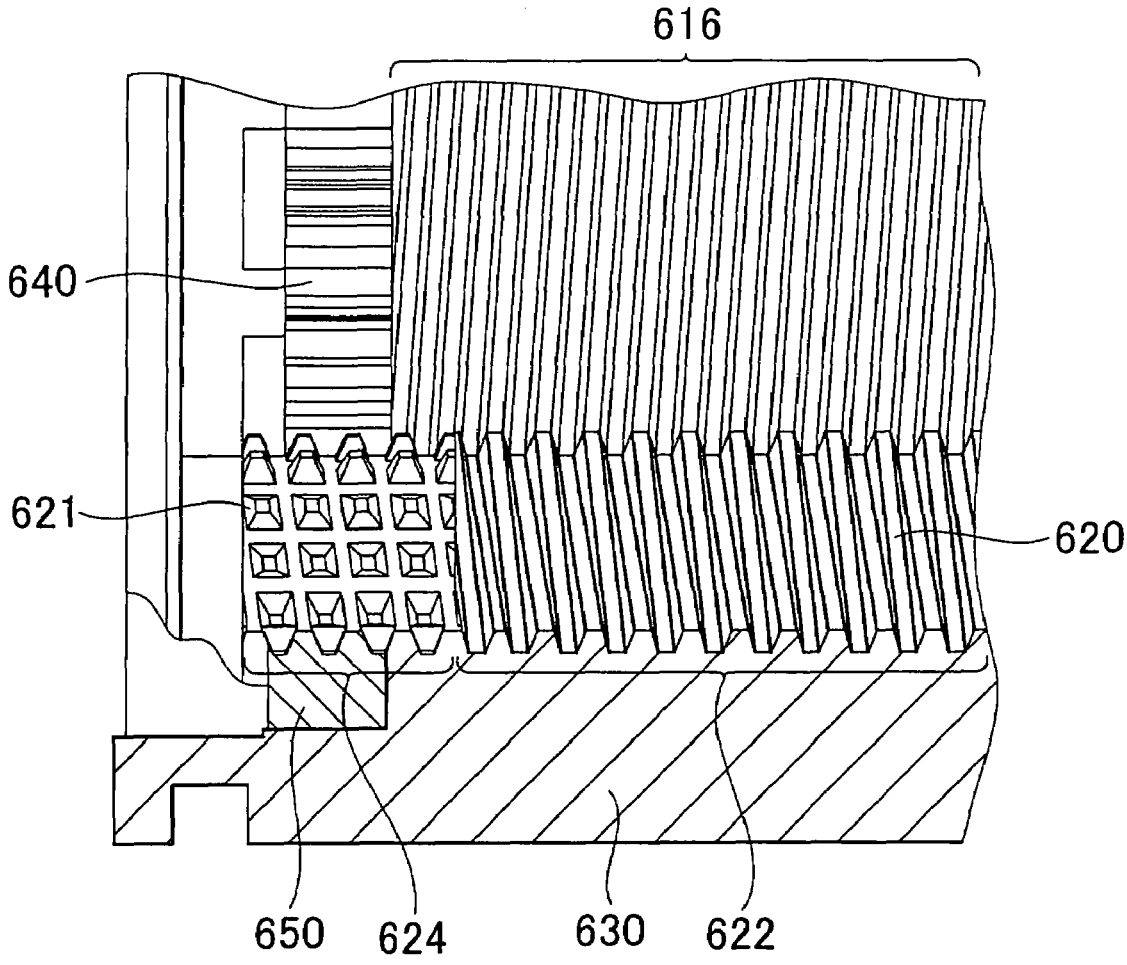
FIG. 6 is an enlarged view showing the detail of the VI portion of the actuator in FIG. 5.

FIG. 6 is an enlarged view showing the detail of the VI portion of the actuator 500 in FIG. 5.

As shown in FIG. 5 and FIG. 6, a male thread is formed in the thread portion 622 of each planetary shaft 620. The male thread formed in the thread portion 622 engages with the male thread formed in the thread portion 616 of the sun shaft 610, and the female thread formed on the inner surface of the nut 630. The torsional direction of the male thread formed in the thread portion 622 of each planetary shaft 620 is opposite to the torsional direction of the male thread formed in the thread portion 616 of the sun shaft 610, and is the same as the torsional direction of the female thread formed on the inner surface of the nut 630.

A spur gear is formed in the gear portion 624 of each planetary shaft 620. The spur gear formed in the gear portion 624 engages with the spur gear formed on the outer surface of the sun gear 640, and the spur gear formed on the inner surface of a ring gear 650. The spur gear is formed, for example, by a roll threading process, or a cutting process, at the end of the planetary shaft 620 in which a male thread is formed on the entire outer surface. A spur gear is also formed in the gear portion 626 of each planetary shaft 620. The spur gear formed in the gear portion 626 engages with the spur gear formed on the inner surface of the ring gear 650.

A bearing fixed to the housing 510 supports the nut 630 such that the nut 630 rotates around the axis 800. A female thread is formed on the inner surface of the nut 630. The torsional direction of the female thread formed on the inner surface of the nut 630 is opposite to the torsional direction of the male thread formed in the thread portion 616 of the sun shaft 610.

The ring gears 650 are fixed to the nut 630 such that the ring gears 650 are positioned on the sides of the inner surface on which the female thread is formed. A spur gear is formed on the inner surface of each ring gear 650. In the spur gear, the teeth are arranged around the axis 800 in the circumferential direction.

The male thread formed in the thread portion 616 of the sun shaft 610, the male thread formed in the thread portion 622 of each planetary shaft 620, and the female thread formed on the inner surface of the nut 630 have the same pitch. Because the sun shaft 610 moves in the direction of the axis 800 during a stroke in this embodiment, the number of helices in each thread is determined, for example, based on the relation represented by the equation, Ns:Np:Nn=(Ds+1):Dp:Dn. In this equation, Ds, Dp, and Dn represent the pitch circle diameters of the male thread formed on the sun shaft 610, the male thread formed on each planetary shaft 620, and the female thread formed on the nut 630, respectively. Ns, Np, and Nn represent the numbers of helices in the male thread formed on the sun shaft 610, the male thread formed on each planetary shaft 620, and the female thread formed on the nut 630, respectively. However, the relation between the pitch circle diameters and the numbers of starts may be represented by other equations.

When the nut 630 rotates, the rotation of the nut 630 is transmitted to each planetary shaft 620, because the female thread formed on the inner surface of the nut 630 engages with the male thread formed in each planetary shaft 620. The spur gear formed in the gear portion 624 of each planetary shaft 620 then engages with the spur gears formed on the outer surface of the sun gear 640 and on the inner surface of the ring gear 650. Also, the spur gear formed in the gear portion 626 of the planetary shaft 620 engages with the spur gear formed on the inner surface of the ring gear 650.

Therefore, each planetary shaft 620 does not move in the direction of the axis 800. However, each planetary shaft 620 moves around the axis 800, while rotating around its axis. At the same time, each planetary shaft 620 is kept parallel with the axis 800 due to the engagement of the above-described spur gears.

Because the thread formed on each planetary shaft 620 engages with the thread formed on the sun shaft 610, the rotational movement of each planetary shaft 620 is transmitted to the sun shaft 610. The stopper collar 516 restricts the rotational movement of the sun shaft 610. Therefore, the sun shaft 610 moves along the direction of the axis 800. As a result, the drive shaft 410 moves linearly. This changes the lift and duration of the intake valve 118, as described above.

As described above, the nut 630, planetary shafts 620, and ring gear 650, sun gear 640, sun shaft 610, stopper collar 516, and the like are regarded as the positioning mechanism that positions the drive shaft 410 according to the rotational position of the rotor of the motor 700.

A sensor 1000 detects the operation amount (i.e., rotational speed or rotational angle) of the motor 700 (rotor 720). The signal that indicates the result of detection is transmitted to the control unit 200. In this embodiment, the control unit 200 indirectly detects the lift and duration of the intake valve 118 based on the operation amount of the motor 700, using a map that indicates the relation between the operation amount of the motor 700, and the lift and duration of the intake valve 118.

According to the duty ratio of the control signal transmitted from the control unit 200, the motor 700, which is the actuator, maintains the drive shaft 410, which is the drive element, in a neutral state, or moves the drive shaft 410 toward the "maximum-side position" to increase the lift and duration, or toward the "minimum-side position" to decrease the lift and duration. When the drive shaft 410 is at the "maximum-side position", the lift is at its maximum, and the duration is longest. When the drive shaft 410 is at the "minimum-side position", the lift is at its minimum, and the duration is shortest.

When the force is applied by the drive shaft 410 along the direction of the axis 800, the motor 700 does not rotate because the thread portion 616 of the sun shaft 610 engages with the thread portion of each planetary shaft 620, and the thread portion of each planetary shaft on the side opposite to the sun shaft 620 engages with the female thread formed in the thread portion 622 of the nut 630. Also, the nut 630 is restrained so that the nut 630 does not move along the direction of the axis 800.

When the force applied by the drive shaft 410 along the direction of the axis 800 is transmitted from the thread ridge on the sun shaft 610 to the thread ridge on each planetary shaft 620, the lateral surface of the thread ridge on each planetary shaft 620 receives the force in the substantially vertical direction. Accordingly, the force for rotating each planetary shaft 620 is hardly generated. When the power source for the motor 700 is turned on to rotate each planetary shaft 620 using the spur gear in the gear portion 626, the sun shaft 610 moves along the direction of the axis 800. However, for example, when the power source for the motor 700 is turned off, the sun shaft 610 does not move, because the position of each planetary shaft 620 is fixed due to the friction caused in the actuator 500. As a result, the drive shaft 410 remains at the same position.

The sensor 1000 may be a sensor that outputs pulses, such as a rotary encoder. The number of pulses is counted. Each of the maximum-side position and the minimum-side position of the drive shaft 410 is learned as the reference value, immediately after an ignition key is turned on. The displacement amount, by which the drive shaft 410 is displaced from the maximum-side position or the minimum-side position, is obtained by adding the counted number of pulses to the reference value. Thus, the control unit 200 obtains the value VC of the duration corresponding to the displacement amount.

Figure 7:
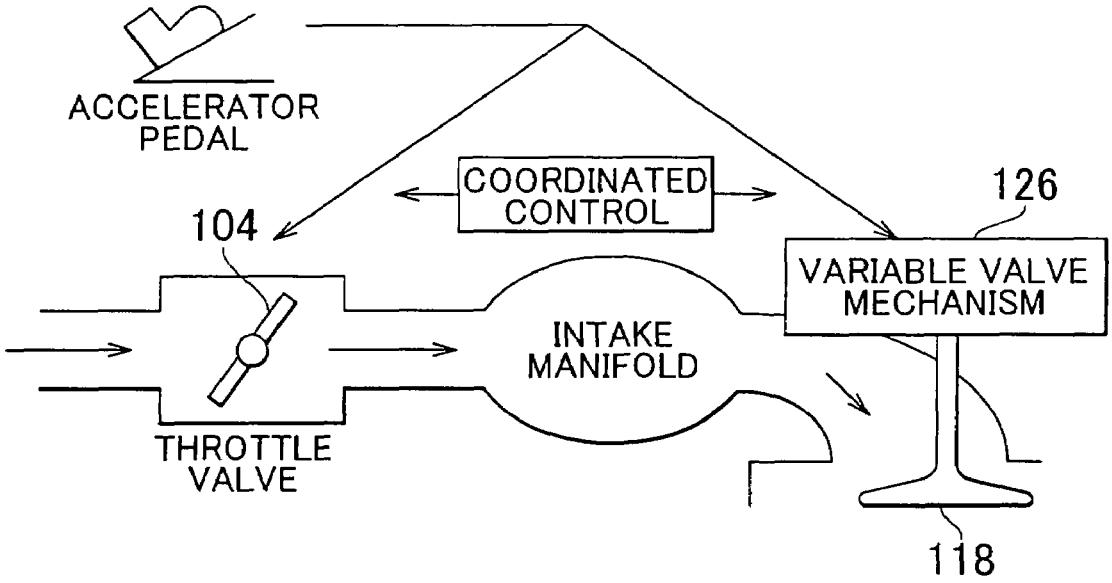
FIG. 7 is a conceptual diagram explaining the coordinated control of a throttle valve and an intake valve.

FIG. 7 is a conceptual diagram explaining the coordinated control of the throttle valve and the intake valve.

As shown in FIG. 7, the amount of air taken into the engine (hereinafter, referred to as "intake air amount") is controlled based on the amount by which the accelerator pedal is depressed. The intake air amount is increased by increasing the opening amount of the throttle valve, or by increasing the period in which the intake valve is held open (i.e., the duration). If the throttle valve is closed after the warming-up of the vehicle is completed, a negative pressure is generated, and pumping loss in the engine increases. Therefore, after the warming-up is completed, the throttle valve is opened to some extent, and the intake air amount is adjusted mainly by changing the duration of the intake valve.

When the engine starts, the viscosity of lubricating oil may be high due to the low temperature of the engine or motor. In this case, the variable-lift actuator may not smoothly move. Therefore, when the engine starts, it is desirable to execute a control that maintains the duration at a large value, and adjusts the intake air amount by changing the opening amount of the throttle valve. After the warming-up is completed, it is desirable to start another control that changes the duration.

Figure 8:
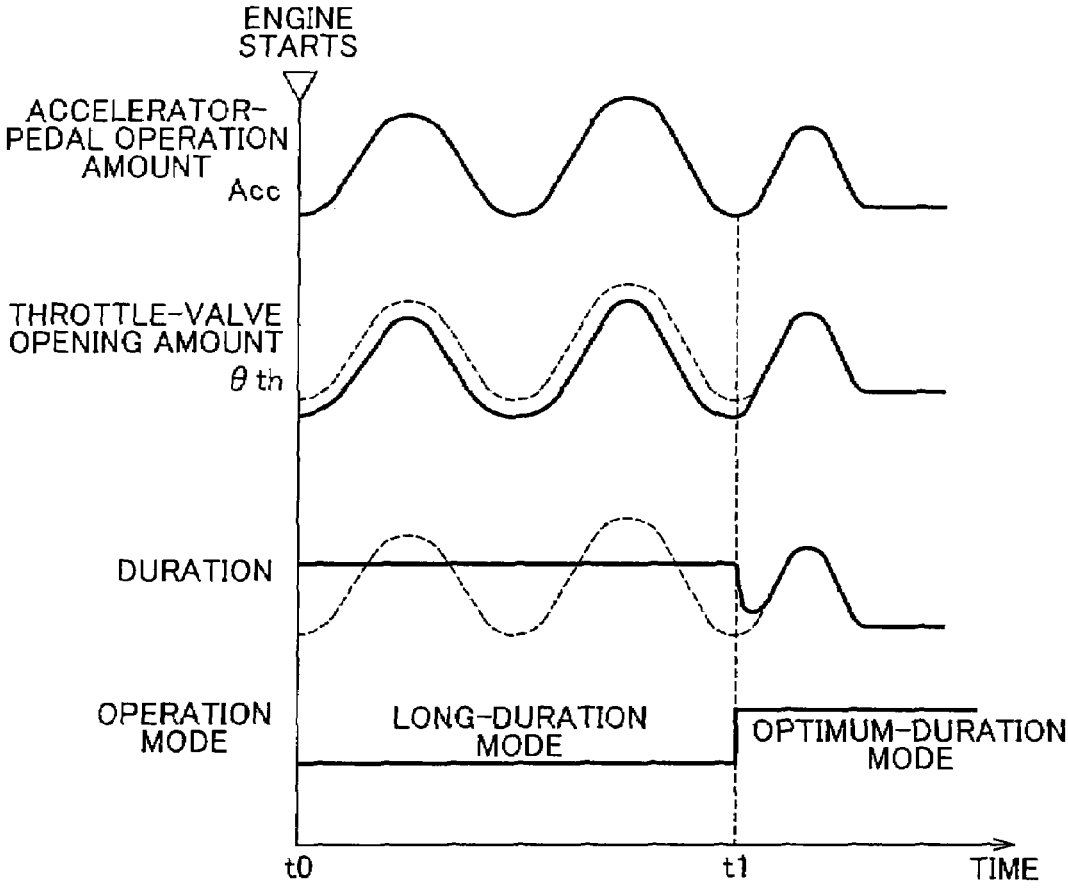
FIG. 8 is an operational waveform diagram explaining the change in the control of the duration.

FIG. 8 is an operational waveform diagram explaining the change in the control of the duration. As shown in FIG. 8, when the engine starts at time point t0, a long-duration mode is selected as the operation mode. The long-duration mode is selected until time point t1. In this long-duration mode, the duration is fixed at some large value (i.e., the period in which the intake valve is held open is fixed at some large value).

When the engine has been sufficiently warmed up at time point t1, the actuator 500 smoothly moves. At this time point, the control unit 200 changes the operation mode from the long-duration mode to the optimum-duration mode.

During the period from time point t0 to time point t1, the dashed lines show the throttle-valve opening amount θth and the duration, which are estimated based on the assumption that the optimum-duration mode is selected. During the period from time point t0 to time point t1, the throttle-valve opening amount θth is slightly decreased, as compared to the throttle-valve opening amount θth determined based on the accelerator-pedal operation amount Acc in the optimum-duration mode. That is, during the period from time point t0 to time point t1, the throttle-valve opening amount θth differs from the throttle-valve opening amount θth in the optimum-duration mode.

After time point t1, the throttle-valve opening amount θth is not decreased. Also, the duration of the intake valve changes according to the accelerator-pedal operation amount Acc.

However, at time point t1, the fixed long duration differs from a target duration in the optimum-duration mode. Accordingly, the duration needs to be changed quickly. When the operation mode is changed to decrease the duration (the period in which the intake valve is held open), the duration and the intake air amount do not change uniformly. Therefore, the operation mode needs to be changed so that the driver does not feel discomfort.

Figure 9:
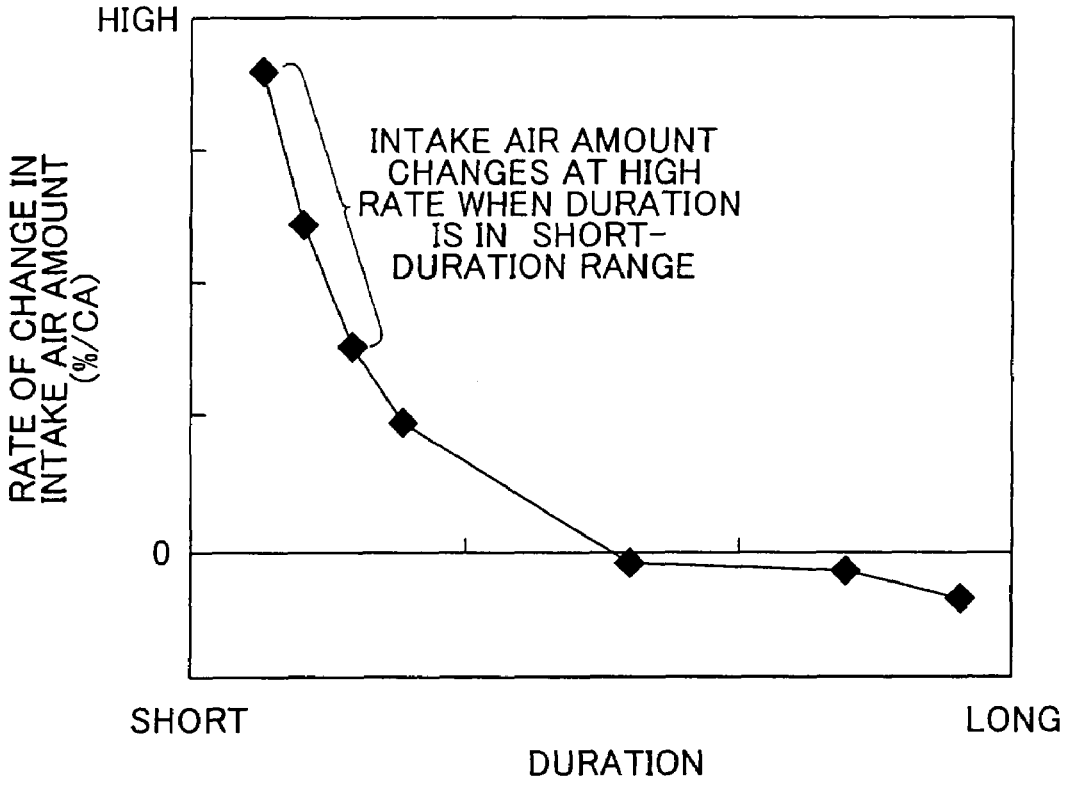
FIG. 9 is a diagram showing the relation between the duration and the rate of change in an intake air amount.

FIG. 9 is a diagram showing the relation between the duration and the rate of change in the intake air amount. As shown in FIG. 9, the horizontal axis indicates the duration shown in FIG. 2. The duration is the period in which the intake valve is held open in terms of crank angle. The vertical axis indicates the rate of change in the intake air amount, that is, the rate at which the intake air amount changes with respect to the change in the duration (Δ intake air amount/Δ duration). As shown in FIG. 9, when the duration is in the short-duration range, the intake air amount changes at a high rate.

Figure 10:
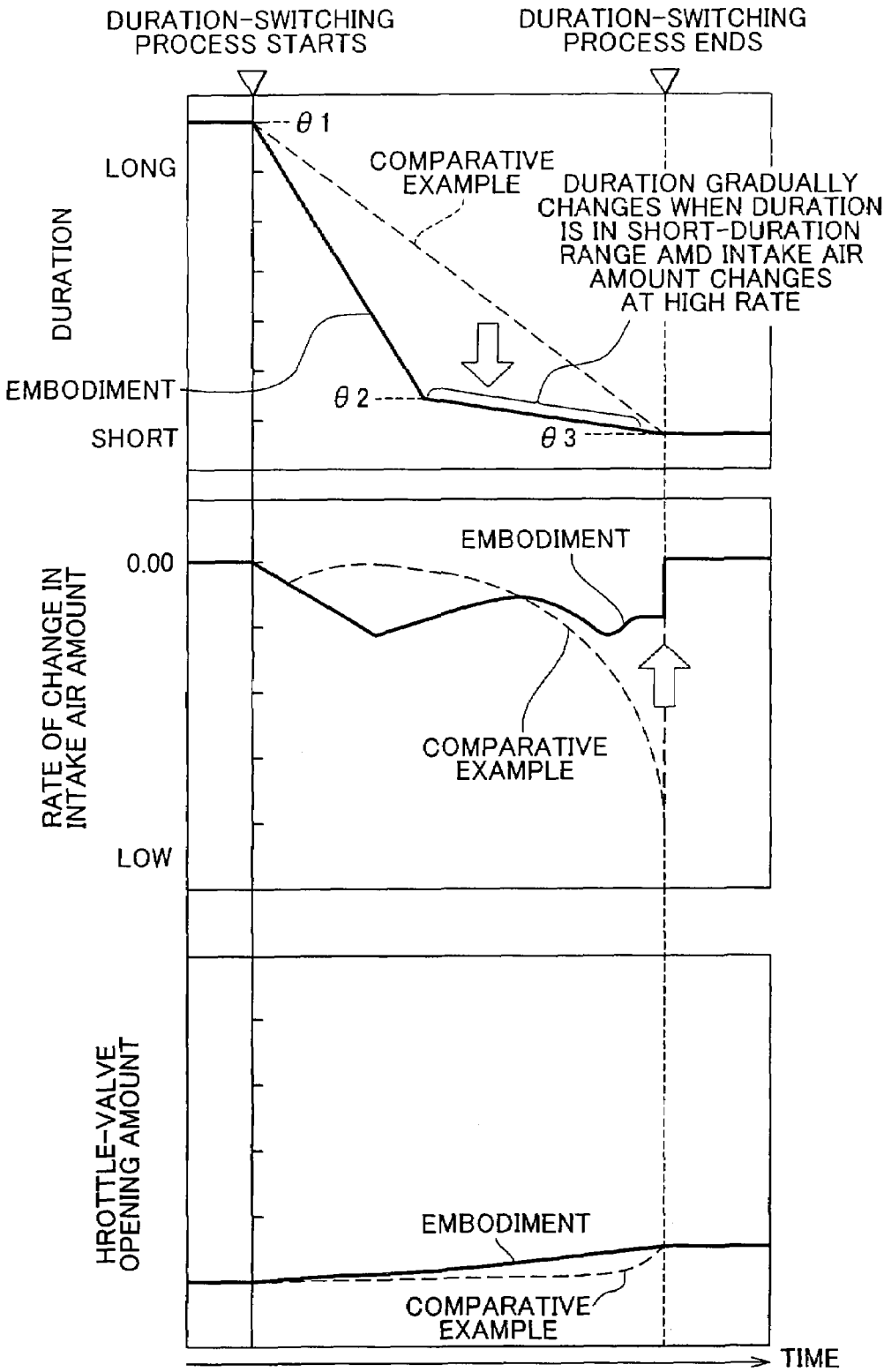
FIG. 10 is a diagram showing a duration-change speed during the period from when a duration-switching process starts until when the duration-switching process ends.

FIG. 10 is the diagram showing the speed at which the duration changes (hereinafter, referred to as "duration-change speed") during the period from when the process of switching the duration from the long duration to the short duration (hereinafter, referred to as "duration-switching process") starts until when the duration-switching process ends.

As shown in FIG. 10, the dashed lines indicate the control executed in a comparative example, and the solid lines indicate the control executed in this embodiment. In the comparative example indicated by the dashed lines, the control is executed so that the duration changes at a uniform speed during the period from when the duration-switching process starts until when the duration-switching process ends. In this case, the rate of change in the intake air amount sharply changes to a negative value immediately before the duration-switching process ends. If the total amount of intake air is controlled using the throttle valve in concert with the intake valve, the amount of change in the throttle-valve opening amount sharply changes. As a result, torque may sharply change.

In contrast, in the control indicated by the solid lines, the actuator is controlled so that the duration-change speed is equal to a first speed when the duration is equal to a first value θ1. The actuator is controlled so that the duration-change speed is equal to a second speed when the duration is equal to a second value θ2 that is smaller than the first value θ1. Because the amount of change in the duration is a negative value, the value of the second speed is larger than the value of the first speed. However, the absolute value of the second speed is smaller than the absolute value of the first speed.

In other words, the control unit 200 controls the actuator so that the duration-change speed is equal to the first speed for a while after the duration-switching process starts, that is, when the duration is in the long-duration range. Then, the control unit 200 controls the actuator so that the duration-change speed is equal to the second speed during the latter half of the duration-switching process, that is, when the duration is in the short-duration range. That is, the duration gradually changes when the duration is in the short-duration range, and the intake air amount changes at a high rate.

The duration may be switched from the short duration to the long duration. In this case, immediately after the process of switching the short duration to the long duration starts, the duration is in the short-duration range, and therefore, the duration changes at a low speed. After the duration enters the long-duration range, the duration changes at a high speed.

Figure 11:
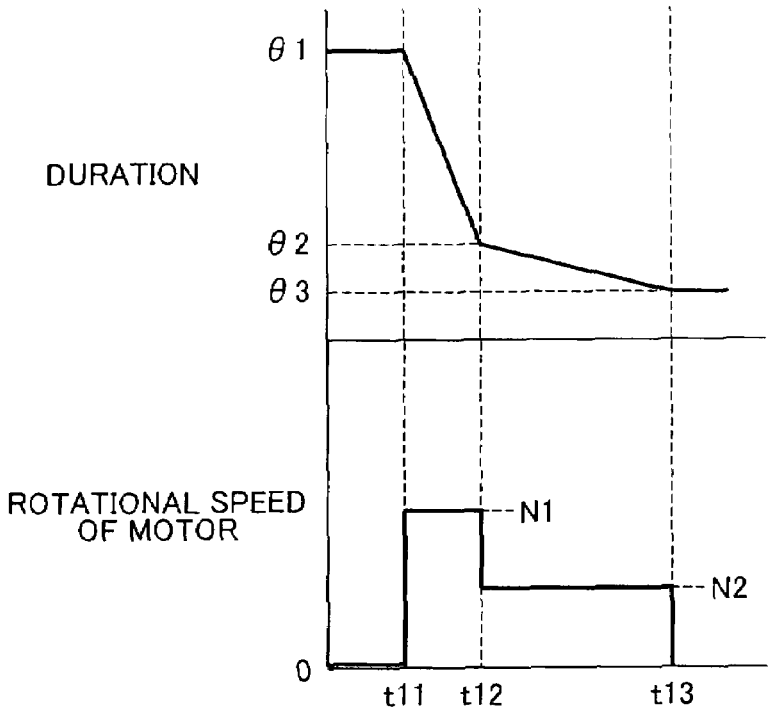
FIG. 11 is a diagram explaining the control of a motor executed when the duration is switched as shown in FIG. 10.

FIG. 11 is a diagram explaining the control of the motor that is executed when the duration is switched as shown in FIG. 10. In FIG. 11, the duration changes in the same manner as in FIG. 10. Therefore, the description of changing the duration will be omitted.

During the period from time point t11 to time point t12, the duration-change speed is equal to the first speed. During this period, the control unit 200 in FIG. 1 controls the motor 700 in FIG. 5 so that the rotational speed is N1, to change the duration at the first speed.

During the period from time point t12 to time point t13, the inclination of the line that indicates the duration changes in the graph. That is, during this period, the control unit 200 controls the motor 700 so that the rotational speed is N2 that is lower than the rotational speed N1. By controlling the motor 700 in this manner, the absolute value of the duration-change speed is increased when the duration is in the long-duration range, and the absolute value of the duration-change speed is decreased when the duration is in the short-duration range.

Figure 12:
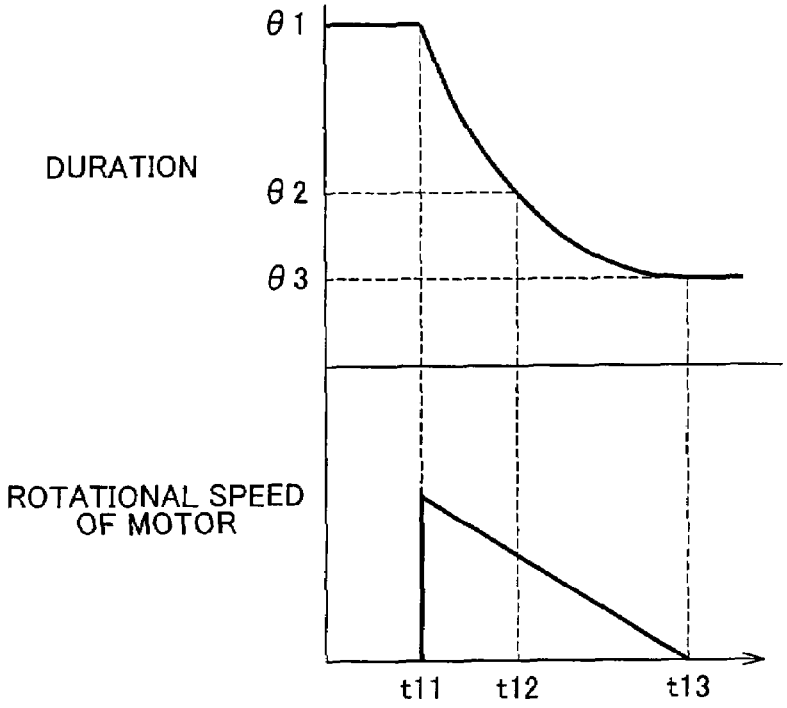
FIG. 12 is a diagram explaining the control of the motor according to a modified example.

FIG. 12 is a diagram explaining the control of the motor according to a modified example. In FIG. 12, the duration is θ1 at time point t11, θ2 at time point t12, and θ3 at time point t13, as in FIG. 11. Also, when the duration is θ2, the absolute value of the duration-change speed is smaller than that when the duration is θ1.

However, in FIG. 12, the duration-change speed changes during the period from time point t11 to time point t13 in a slightly different manner, as compared to FIG. 11. In FIG. 11, the motor is controlled so that the duration-change speed changes in two steps. In contrast, in FIG. 12, the motor is controlled so that the absolute value of the duration-change speed continuously decreases during the period from time point t11 to time point t13.

That is, in FIG. 12, the rotational speed of the motor 700 is highest at time point t11, and zero at time point t13. During the period from time point t11 to time point t13, the rotational speed of the motor 700 continuously decreases. By controlling the motor 700 in this manner, it is possible to avoid sharp changes in the throttle-valve opening amount shown in FIG. 10. As a result, the torque may either be maintained at a constant value, or gradually changed. Thus, the driver can drive the vehicle without feeling discomfort.

Other controls that have characteristics intermediate between those of the controls shown in FIG. 11 and FIG. 12 may be executed. For example, the motor 700 may be controlled so that the rotational speed decreases in a plurality of steps such as three steps or four-steps.

As described above, according to the embodiment of the invention, when the duration is changed by the variable valve mechanism, it is possible to avoid a sharp change in the throttle-valve opening amount. Thus, the driver can drive the vehicle without feeling discomfort.

In this embodiment, the intake valve has been described. When a similar variable valve mechanism is employed for the exhaust valve, the invention can be applied to the exhaust valve.

Thus, the embodiment of the invention that has been disclosed in the specification is to be considered in all respects as illustrative and not restrictive. The technical scope of the invention is defined by claims, and all changes that come within the meaning and range of equivalency of the claims are therefore intended to be embraced therein.

What is claimed is:

1. A control device for a variable valve mechanism that changes an operational characteristic of an intake valve provided in an internal combustion engine, comprising:

a control unit;

a drive element; and an actuator, provided in the variable valve mechanism, that changes a duration of the intake valve by moving the drive element, the duration being a period of time in terms of crank angle that the intake valve is held open;

wherein, when the control unit changes the duration of the intake valve to achieve a desired duration value of the intake valve, the control unit controls the actuator so that the duration changes at a first speed when the duration is equal to a first value, and changes at a second speed when the duration is equal to a second value that is smaller than the first value, the duration changing at the second speed between when the duration is equal to the first value and when the duration is equal to the desired duration value; and an absolute value of the second speed is smaller than an absolute value of the first speed.

2. The control device for the variable valve mechanism according to claim 1, wherein the control unit controls the actuator so that the duration changes at the first speed when the duration is in a long-duration range that includes the first value, and changes at the second speed when the duration is in a short-duration range that includes the second value.

3. The control device for the variable valve mechanism according to claim 1, further comprising:

a motor, provided in the actuator;

a positioning mechanism, also provided in the actuator, that positions the drive element according to a rotational position of a rotor of the motor, wherein the control unit controls the motor so that the rotational speed of the motor when the duration is equal to the second value is lower than the rotational speed of the motor when the duration is equal to the first value.

4. The control device for the variable valve mechanism according to claim 3, wherein the rotational speed of the motor when the duration is equal to the first value is reduced in a plurality of steps to the rotational speed of the motor when the duration is equal to the second value.

5. The control device for the variable valve mechanism according to claim 3, wherein the rotational speed of the motor when the duration is equal to the first value is reduced in a continuous manner to the rotational speed of the motor when the duration is equal to the second value.

6. The control device for the variable valve mechanism according to claim 1, wherein the control unit controls an opening amount of a throttle valve in accordance with the duration of the intake valve.

7. A method of controlling a variable valve mechanism that changes an operational characteristic of an intake valve provided in an internal combustion engine, comprising:

actuating an actuator, provided in the variable valve mechanism, that moves a drive element to change a duration of the intake valve, the duration being a period of time in terms of crank angle that the intake valve is held open; and controlling the actuator, when changing the duration of the intake valve to achieve a desired duration value of the intake valve, so that the duration changes at a first speed when the duration is equal to a first value, and changes at a second speed when the duration is equal to a second value that is smaller than the first value, the duration changing at the second speed between when the duration is equal to the first value and when the duration is equal to the desired duration value, wherein an absolute value of the second speed is smaller than an absolute value of the first speed.

8. The method for controlling the variable valve mechanism according to claim 7, wherein the step of controlling the actuator includes controlling the actuator to change the duration at the first speed when the duration is in a long-duration range that includes the first value, and to change the duration at the second speed when the duration is in a short-duration range that includes the second value.

9. The method for controlling the variable valve mechanism according to claim 7, further comprising:

positioning the drive element according to a rotational position of a rotor of a motor, provided in the actuator;

wherein the step of controlling the actuator includes controlling the motor so that the rotational speed of the motor when the duration is equal to the second value is lower than the rotational speed of the motor when the duration is equal to the first value.

10. The method for controlling the variable valve mechanism according to claim 9, wherein the rotational speed of the motor when the duration is equal to the first value is reduced in a plurality of steps to the rotational speed of the motor when the duration is equal to the second value.

11. The method for controlling the variable valve mechanism according to claim 9, wherein the rotational speed of the motor when the duration is equal to the first value is reduced in a continuous manner to the rotational speed of the motor when the duration is equal to the second value.

12. The method for controlling the variable valve mechanism according to claim 7 further comprising, controlling an opening amount of a throttle valve according to the duration of the intake valve.

* * * * *